US009930921B2

(12) United States Patent
van Heerden et al.

(10) Patent No.: US 9,930,921 B2
(45) Date of Patent: Apr. 3, 2018

(54) DRINKING ARRANGEMENT

(71) Applicant: Garry Ray van Heerden, Milnerton (ZA)

(72) Inventors: Garry Ray van Heerden, Milnerton (ZA); Rony Papadopoulos, Milnerton (ZA)

(73) Assignee: Garry Ray van Heerden, Milnerton (ZA)

( * ) Notice: Subject to any disclaimer, the term of this patent is extended or adjusted under 35 U.S.C. 154(b) by 39 days.

(21) Appl. No.: 15/116,051

(22) PCT Filed: Jun. 4, 2014

(86) PCT No.: PCT/IB2014/061940
§ 371 (c)(1),
(2) Date: Aug. 2, 2016

(87) PCT Pub. No.: WO2015/075567
PCT Pub. Date: May 28, 2015

(65) Prior Publication Data

US 2017/0035136 A1 Feb. 9, 2017

(30) Foreign Application Priority Data

Nov. 21, 2013 (ZA) ..... 2013/08748

(51) Int. Cl.
*A42B 3/00* (2006.01)
*A42B 3/04* (2006.01)
*B63C 11/02* (2006.01)

(52) U.S. Cl.
CPC ..... *A42B 3/048* (2013.01); *B63C 11/02* (2013.01)

(58) Field of Classification Search
CPC ..... A42B 3/048; A42B 1/24; A42B 1/004; A42B 3/0406; B63C 11/02
USPC ..... 224/148.2
See application file for complete search history.

(56) References Cited

U.S. PATENT DOCUMENTS 3,841,740 A * 10/1974 Lacy ..... A61F 9/067 351/44
4,369,782 A * 1/1983 McGee ..... A42B 3/0406 2/410
4,813,083 A * 3/1989 Davidson ..... A42B 3/048 2/12
4,921,141 A * 5/1990 Branum ..... A42B 1/24 222/146.6
5,148,950 A * 9/1992 Hosaka ..... A42B 3/048 2/422

(Continued)

OTHER PUBLICATIONS

International Search Report for PCT/IB2014/061940, dated Aug. 6, 2014.

(Continued)

*Primary Examiner* — Peter Helvey
(74) *Attorney, Agent, or Firm* — Stephen J. Weyer, Esq.; Stites & Harbison, PLLC

(57) ABSTRACT

The invention discloses a drinking arrangement for location within a diver's helmet, which includes a container being adapted to contain a hydration fluid; support means for supporting the container within the helmet; a supply line being adapted to supply flow of the hydration fluid from the container; and a mouthpiece for normally sealing the supply line and being adapted to selectively dispense hydration liquid therefrom.

14 Claims, 2 Drawing Sheets

(56) References Cited

U.S. PATENT DOCUMENTS

| | | | | | |
|---|---|---|---|---|---|
| 5,377,912 | A * | 1/1995 | Webb | A62C 3/07 | 169/52 |
| 5,940,880 | A * | 8/1999 | Phillips | A42B 3/048 | 2/181 |
| 5,966,743 | A * | 10/1999 | Flann | A42B 1/004 | 2/209.11 |
| D448,527 | S * | 9/2001 | Sav | D29/103 | |
| 6,283,344 | B1 * | 9/2001 | Bradley | A42B 1/24 | 222/175 |
| 6,292,952 | B1 * | 9/2001 | Watters | A42B 3/08 | 2/411 |
| 7,398,562 | B2 * | 7/2008 | Mollo | A42B 1/004 | 2/209.13 |
| D617,535 | S * | 6/2010 | Clement | D2/866 | |
| 8,856,972 | B2 * | 10/2014 | Kirshon | A42B 3/121 | 2/413 |
| 9,179,724 | B1 * | 11/2015 | Schultz | A42B 3/048 | |

OTHER PUBLICATIONS

Written Opinion of the International Searching Authority for PCT/IB2014/061940, dated Aug. 6, 2014.
Search Information Statement (SIS) for PCT/IB2014/061940, completed Aug. 6, 2014.
International Preliminary Report on Patentability for PCT/IB2014/061940, completed May 24, 2016.

* cited by examiner

DRINKING ARRANGEMENT

FIELD OF INVENTION

The present invention relates to a drinking arrangement.

More particularly, the present invention relates to a drinking arrangement for a diver for location inside a diver's helmet.

BACKGROUND TO INVENTION

Commercial marine divers often work in dry-suits or warm water suits that are provided with a helmet to permit improved safety, comfort and vision for the diver. Such underwater work normally requires highly skilled divers who operate in shifts for long hours of about 6 to 8 hours. Furthermore, the great depths at which the work is conducted and the heavy equipment used by the divers does not permit them to surface spontaneously as they are often required to undergo decompression. During their shifts the divers lose a large amount of body fluids and they can become dehydrated, which in turn leads to health and safety issues. It is thus important that the divers are provided with hydration during their dive shift.

Although the applicant is aware of various prior art documents that provide such hydration devices for divers, these primarily all support the hydration fluid externally of the dive suit requiring a feed tube to pass through the suit or diver's helmet at some point, which accordingly breaches the integrity of the suit and thus can lead to weakness therein that may lead to failure.

It is an object of the invention to suggest a drinking arrangement, which will assist in overcoming these problems.

SUMMARY OF INVENTION

According to the invention, a drinking arrangement for location within a diver's helmet includes (a) a container, e.g. a bladder, being adapted to contain a hydration fluid;

(b) support means for supporting the container within the helmet;

(c) a supply line being adapted to supply flow of the hydration fluid from the container; and (d) a mouthpiece for normally sealing the supply line and being adapted to selectively dispense hydration liquid therefrom.

The diver's helmet may be adapted to encompass a head of a diver.

The support means may include a hat liner being adapted to be worn on a head of a diver within the diver's helmet.

The bladder may be peripherally joined to the hat liner.

The bladder may be removably joined to the hat liner, for example such as by press studs, buttons or other releasable attachment means.

The bladder may be integrally formed with the hat liner.

The bladder may have an internal honeycomb structure being adapted to provide additional strength and support to the bladder.

The supply line may be a tube projecting from one end of the bladder.

The supply line may project through an oral-nasal mask worn by a diver, whereby the mask is adapted to support the mouthpiece within easy reach of a diver's mouth.

The mouthpiece may be adapted to be opened to permit flow of the hydration liquid by a diver sucking or biting on the mouthpiece.

The mouthpiece may function as an inlet for filling the bladder with the hydration liquid.

The hydration liquid may be water or any other sustenance drink.

The invention extends to a hat liner provided with a drinking arrangement as described herein.

The invention further extends to a diver's helmet provided with a drinking arrangement as described herein.

BRIEF DESCRIPTION OF DRAWINGS

The invention will now be described by way of example with reference to the accompanying schematic drawings.

In the drawings there is shown in.

DETAILED DESCRIPTION OF DRAWINGS

Figure 1:
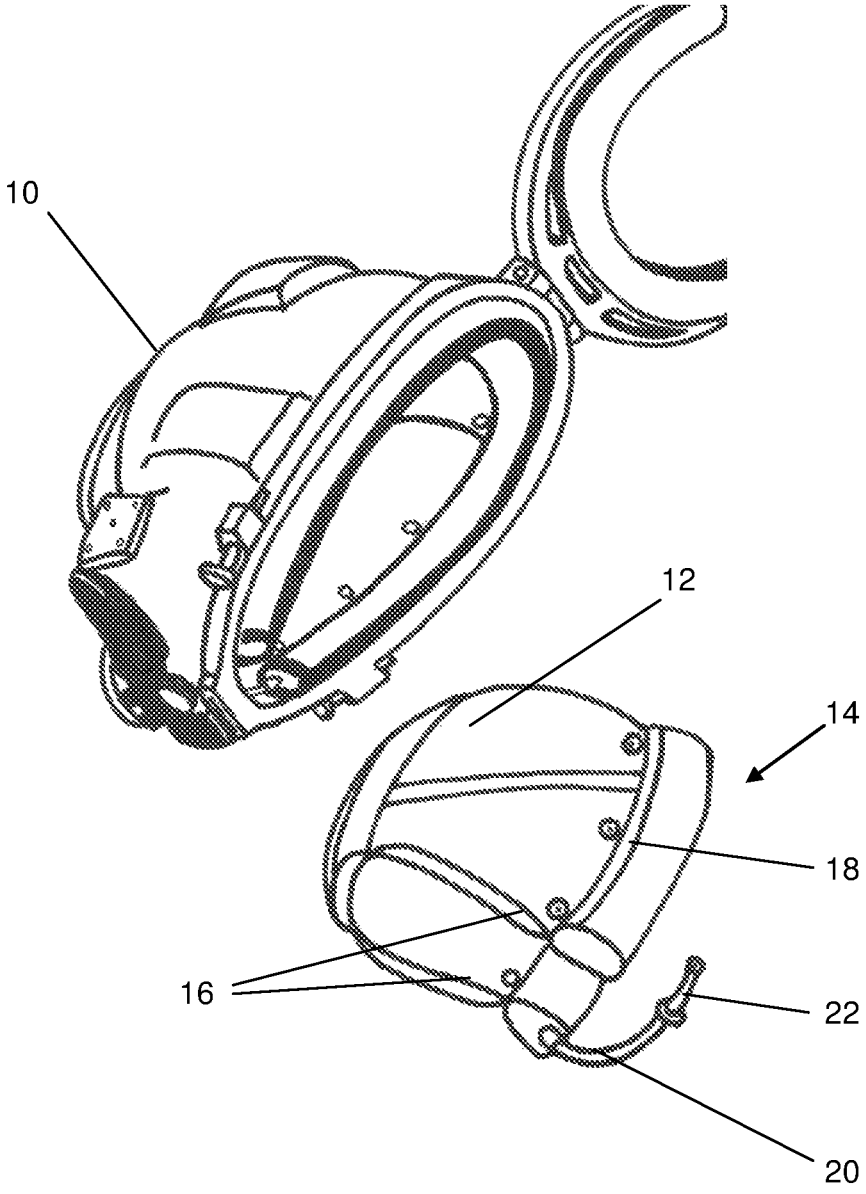
FIG. 1: A perspective view of a diving helmet and helmet hat liner provided with a drinking arrangement according to the invention.

Referring to FIG. 1 of the drawings, there is shown a diving helmet, being generally indicated by reference numeral 10, and a hat liner 12 being adapted to be worn by a diver over his head inside the helmet 10. A drinking arrangement 14 in accordance with the invention is shown being removably joined peripherally to the hat liner 12 by a number of press studs 16. It is further envisaged that the drinking arrangement 14 can be integrally formed with the hat liner 12.

The drinking arrangement 14 is a hollow bladder 18 having an outlet tube 20 projecting at one end, which terminates in mouthpiece 22. The bladder 18 is adapted to contain a hydration liquid, preferably such as water or other sustenance drink. The bladder 18 can have an internal honeycomb structure to provide additional strength and support to the bladder 18 so that it substantially retains its shape when being either filled with or empty of the liquid.

The mouthpiece 22 can also be used as an inlet for filling the bladder 18 with the liquid. Alternatively, a separate filling valve (not shown) can be provided in the bladder 18 remotely from the tube 20. The mouthpiece 22 is of the type having a seal being normally closed against the outflow of liquid, which seal is opened by a diver or person sucking or biting on the mouthpiece 22 to break the seal and permit flow of the liquid into the person's mouth.

Figure 2:
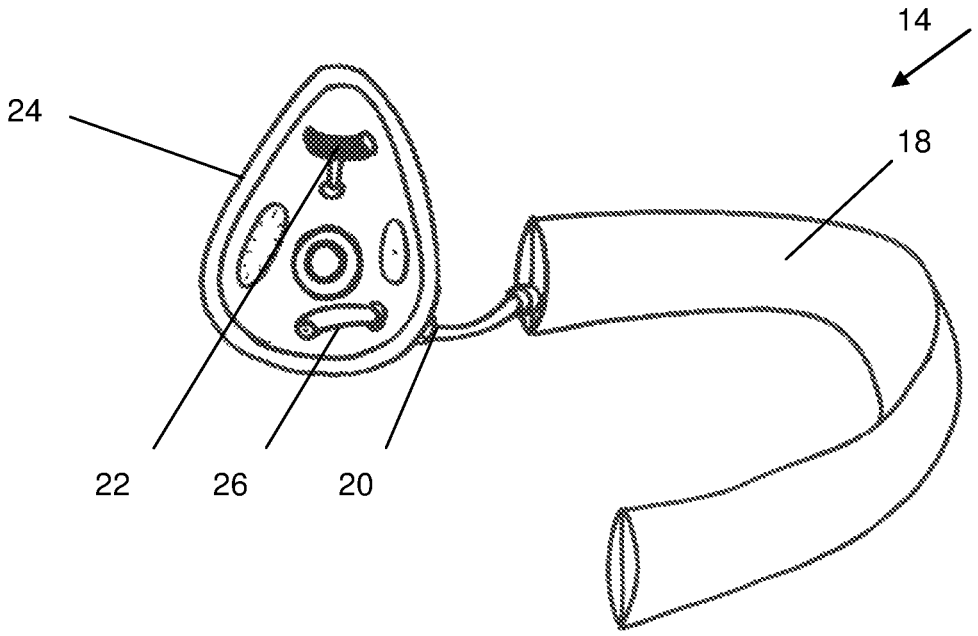
FIG. 2: A perspective view of the drinking arrangement shown in FIG. 1.

Referring to FIG. 2, a diver wearing the helmet 10 normally also wears an oral-nasal mask 24, which is adapted to cover his nose and mouth. The tube 20 projects through a passage 26 provided in the mask 24 so that the mouthpiece 22 is supported within easy reach of the diver's mouth. The diver, in use, is able to place his mouth onto the mouthpiece 22 to suck or bite thereon to periodically take sips of the hydration liquid.

Due thereto that the bladder 18 is located and supported within the helmet 10, neither the tube 20 nor the mouthpiece 22 need to pass through the diver's suit or the helmet 10. There is thus no breach in the integrity of the suit or helmet 10 and thus an improved safety for the diver.

A removable plug may be provided for sealing off the oral nasal mask 24 when the drinking tube 26 is removed.

The invention claimed is:

1. A drinking arrangement system comprising:

(a) a diver's helmet adapted to engage with a dry-suit or warm water suit in a watertight arrangement;

(b) a container being adapted to contain a hydration fluid and disposed within the helmet;

(c) support means for supporting the container within the helmet;

(d) a supply line being adapted to supply flow of the hydration fluid from the container; and (e) a mouthpiece for normally sealing the supply line and being adapted to selectively dispense hydration liquid therefrom.

2. The drinking arrangement system as claimed in claim 1, in which the container is a bladder.

3. The drinking arrangement system as claimed in claim 1, in which the diver's helmet is adapted to encompass a head of a diver.

4. The drinking arrangement system as claimed in claim 1, in which the support means include a hat liner being adapted to be worn on a head of a diver within the diver's helmet.

5. The drinking arrangement system as claimed in claim 1, in which the container is peripherally joined to the hat liner.

6. The drinking arrangement system as claimed in claim 4, in which the bladder is removably joined to the hat liner, for example such as by press studs, buttons or other releasable attachment means.

7. The drinking arrangement system as claimed in claim 4, in which the container is integrally formed with the hat liner.

8. The drinking arrangement system as claimed in claim 1, in which the container has an internal honeycomb structure being adapted to provide additional strength and support to the container.

9. The drinking arrangement system as claimed in claim 1, in which the supply line is a tube projecting from one end of the container.

10. The drinking arrangement system as claimed in claim 1, in which the supply line projects through an oral-nasal mask worn by a diver, whereby the mask is adapted to support the mouthpiece within easy reach of a diver's mouth.

11. The drinking arrangement system as claimed in claim 1, in which the mouthpiece is adapted to be opened to permit flow of the hydration liquid by a diver sucking or biting on the mouthpiece.

12. The drinking arrangement system as claimed in claim 1, in which the mouthpiece functions as an inlet for filling the bladder with the hydration liquid.

13. The drinking arrangement system as claimed in claim 1, in which the hydration liquid is water and/or any other sustenance drink.

14. The drinking arrangement system of claim 1 further comprising a hat liner provided within the diver's helmet.

* * * * *